US006665980B2

(12) United States Patent
Laske, Jr.

(10) Patent No.: US 6,665,980 B2
(45) Date of Patent: Dec. 23, 2003

(54) PLANT STAND

(76) Inventor: Lawrence L. Laske, Jr., 207 Carroll SE., Grand Rapids, MI (US) 49506

( * ) Notice: Subject to any disclaimer, the term of this patent is extended or adjusted under 35 U.S.C. 154(b) by 0 days.

(21) Appl. No.: 10/037,158

(22) Filed: Oct. 19, 2001

(65) Prior Publication Data

US 2003/0074834 A1 Apr. 24, 2003

(51) Int. Cl.[7] ..... A47G 7/00

(52) U.S. Cl. ..... 47/39; 47/66.6; 47/71; 47/47; 47/41.14; 248/128; 248/146

(58) Field of Search ..... 47/65, 66.6, 71, 47/83, 39, 47, 41.14, 41.01, 86, 87; 248/128, 146

(56) References Cited

U.S. PATENT DOCUMENTS

| | | | | | |
|---|---|---|---|---|---|
| 296,028 | A | | 4/1884 | Martin | |
| 492,919 | A | * | 3/1893 | Gridley | 248/310 |
| 585,486 | A | * | 6/1897 | Snow | 211/60.1 |
| 585,931 | A | * | 7/1897 | Gridley | 211/74 |
| 964,196 | A | * | 7/1910 | Aul | |
| 1,043,386 | A | | 11/1912 | Astruck | |
| 1,357,777 | A | * | 11/1920 | Hastings | 47/39 |
| 1,391,353 | A | * | 9/1921 | Wells | |
| 1,599,616 | A | | 9/1926 | Hamburger | |
| 1,609,246 | A | * | 11/1926 | Hamburger | |
| 1,806,123 | A | | 5/1931 | Smith | |
| 1,852,650 | A | * | 4/1932 | Halberstadter | 248/208 |
| 1,877,098 | A | * | 9/1932 | Washburn | 248/146 |
| 2,003,986 | A | | 6/1935 | Witthuhn | |
| 2,143,338 | A | * | 1/1939 | Watkins | 108/92 |
| 2,746,208 | A | * | 5/1956 | Lewis | |
| 3,084,666 | A | | 4/1963 | Plaisance | |
| 3,107,028 | A | * | 10/1963 | Robertis | |
| 3,381,410 | A | * | 5/1968 | Potain | 47/71 |
| 3,879,889 | A | * | 4/1975 | Schmid | 47/1.2 |
| 4,020,592 | A | * | 5/1977 | Saunders | 47/71 |
| 4,102,081 | A | * | 7/1978 | Morrow | 47/67 |
| 4,125,965 | A | | 11/1978 | Schweim | |
| 4,227,343 | A | | 10/1980 | Espy et al. | |
| 4,442,629 | A | * | 4/1984 | Anderson | 47/67 |
| 4,454,681 | A | * | 6/1984 | White | 248/500 |
| 4,597,221 | A | * | 7/1986 | Adair et al. | 47/66.6 |
| 4,635,394 | A | * | 1/1987 | Brown | 47/67 |
| 4,912,875 | A | * | 4/1990 | Tardif | 47/67 |
| D327,182 | S | * | 6/1992 | Ma | D6/403 |
| 5,152,098 | A | | 10/1992 | Hall | |
| 5,269,095 | A | | 12/1993 | Helfman et al. | |
| D363,255 | S | * | 10/1995 | Helms et al. | D11/164 |
| 5,577,344 | A | | 11/1996 | Zaremba et al. | |
| 5,644,867 | A | * | 7/1997 | Gay | 47/65.6 |
| 5,649,386 | A | * | 7/1997 | Rynberk | 248/310 |
| 6,029,937 | A | | 2/2000 | Funaro | |
| 6,345,466 | B1 | * | 2/2002 | Venanzi | 47/66.1 |

FOREIGN PATENT DOCUMENTS

| | | | | |
|---|---|---|---|---|
| GB | 1444834 | * | 5/1974 | A01G/9/02 |

* cited by examiner

*Primary Examiner*—Peter M. Poon
*Assistant Examiner*—Andrea M. Valenti
(74) *Attorney, Agent, or Firm*—Pauley Petersen & Erickson

(57) ABSTRACT

An apparatus, for example a stand, for supporting an object such as a house plant, with respect to a support post having a vertical axis. A container having a bottom surface which forms a receptacle is mateably engageable with a projection formed in a top surface of a drainage plate. The drainage plate is connected to an upper end portion of the support post, whereby the container is positioned with respect to the support post and aligned with the vertical axis. In one embodiment of this invention, the drainage plate is connected to an end portion of a mounting bracket, whereby the container is fixedly positioned with respect to a generally vertical surface.

6 Claims, 6 Drawing Sheets

PLANT STAND

BACKGROUND OF THE INVENTION

1. Field of the Invention

This invention relates to an apparatus for holding or supporting an object, such as a house plant, with respect to a support post or a mounting bracket. More specifically, this invention relates to a plant stand having a drainage plate mateably engageable with a container or pot, whereby the container or pot is centered about a vertical axis of a support post or an end portion of the mounting bracket, connected to a receiving surface of the drainage plate.

2. Description of Related Art

Conventional plant containers may include a pot having a general conical shape which is positioned upon a generally flat surface or drainage piece. Some conventional plant containers are adapted to be supported by a support means having a support rod and a base which rests on a generally flat surface, for example a floor. Alternatively, other conventional plant containers are adapted to be suspended from an overhead support structure, for example a ceiling.

One disadvantage associated with conventional plant containers is that many conventional plant containers do not have a drainage piece or surface which supports the pot to maintain the pot in a desired or predetermined location on the drainage piece. Additionally, such drainage pieces may not be rigidly fastened or connected to a support base. Further, these conventional plant containers do not provide a means by which the drainage piece is connected to the pot to maintain the pot in a general vertical position with respect to the drainage piece and/or the support means, for example to prevent the pot, and/or the entire support means, from tipping over.

Another disadvantage associated with conventional plant containers is that a combination of the drainage piece and the pot cannot be used separately from the support means because the drainage piece does not have a generally flat bottom surface. Instead, the bottom surface of a conventional drainage piece usually has a connecting surface or portion which is not planar with the bottom surface. Thus, when rested upon a generally flat, horizontal surface, the drainage piece tips causing the pot to tip and at least a portion of the contents of the pot to spill.

Thus, there is an apparent need for an apparatus for supporting an object, such as a plant, having a container or pot which is mateably engageable with a drainage plate to maintain the apparatus in a vertical position, preferably to prevent tipping.

SUMMARY OF THE INVENTION

It is an object of this invention to provide an apparatus for supporting an object, for example a stand for supporting a plant within a pot positioned with respect to a support post.

It is another object of this invention to provide a pot which is mateably engageable with a drainage plate to maintain the pot in a vertical position with respect to a support post rigidly connected to the drainage plate.

It is yet another object of this invention to provide a drainage plate having a projection which is mateably engageable with a receptacle formed in a bottom surface of a pot to align the pot with a vertical axis of a support post and prevent axial movement of the pot with resect to the drainage plate and/or the support post.

It is yet another object of this invention to provide an apparatus for supporting an object positioned with respect to a mounting bracket.

The above and other objects of this invention are accomplished with an apparatus, for example a plant stand, for supporting an object, such as a house plant, which includes a support post having a vertical axis. Preferably, but not necessarily, the support post is generally cylindrical along its length and has a generally circular cross-sectional area. The support post may have other suitable cross-sectional areas, such as a rectangular cross-sectional area or a triangular cross-sectional area. The support post is securely attached or connected at a bottom end portion to a base. Suitable means for connecting the support post to the base, such as a threaded connection, are well known to those having ordinary skill in the art. Preferably, the base has a plurality of feet, for example three or four feet, to support the apparatus.

An upper end portion of the support post is connected to a drainage plate. Preferably, but not necessarily, the drainage plate is securely connected to the support post using connecting means or a connector, such as a threaded connection. In one preferred embodiment of this invention, the drainage plate has a bottom surface which forms a receiving surface. The support post is mounted within a bore formed by the receiving surface and mateably engages the receiving surface so that the frictional fit forms a secure connection. Preferably, the receiving surface extends or projects into a void or a volume formed by the drainage plate. Thus, at least a portion of the bottom surface of the drainage plate is generally flat, allowing it to rest upon a generally flat, horizontal surface.

In one preferred embodiment of this invention, the drainage plate further forms a projection coaxially positioned with the receiving surface and in an assembled condition is generally aligned with the vertical axis of the support post. Preferably, the projection, as well as the receiving surface, is molded or integrated with the drainage plate. Preferably, but not necessarily, the projection has a generally conical shape. The projection may have any other suitable shape. A peripheral wall of the drainage plate forms or defines a volume within which water, for example may be contained.

A container or pot having a bottom surface which forms a receptacle is mateably engageable with the projection formed by the drainage plate. In one preferred embodiment of this invention, at least a portion of the receptacle extends into a volume formed by a peripheral wall of the container. Thus, at least a portion of the bottom surface of the container is generally flat and can easily rest upon an inner surface of the drainage plate. Preferably, in mating engagement, the receptacle is generally aligned with the projection and thus is generally aligned with the vertical axis of the support post. In one preferred embodiment of this invention, a center of mass of the container is fixedly positioned about the vertical axis. Thus, the apparatus stands upright without tipping and/or falling over when the container is filled with potting soil and a plant, for example.

In one preferred embodiment of this invention, the projection has a surface which corresponds directly with a surface of the receptacle to provide direct contact between a substantial portion of the projection and the receptacle when mateably engaged. Thus, the container is maintained in a generally central location on the upper surface of the drainage plate and is prevented from moving in a vertical direction and/or a lateral direction with respect to the drainage plate.

In one preferred embodiment of this invention, the container further includes at least one aperture formed by and through the bottom surface of the container to provide for drainage. Preferably, but not necessarily, a plurality of apertures are radially positioned about the receptacle. When watering a plant contained within the container, excess water can drain from the volume of the container through the at least one aperture to prevent over-watering of the plant.

In one preferred embodiment of this invention, the bottom surface of the container further includes at least one support wall. Preferably, a plurality of arcuate-shaped support walls extend from the bottom surface and are radially positioned about the receptacle. It is apparent that the support walls may have any suitable shape. The support walls provide stability to the container when the container is positioned upon the drainage plate and the projection is mateably engaged with the receptacle. Further, the support walls provide a means for directing the excess water, exiting the bottom surface of the container through the at least one aperture, to a periphery of the drainage plate.

In one preferred embodiment of this invention, an apparatus for supporting an object such as a house plant comprises a mounting bracket having a first end portion adapted for mounting the apparatus to a surface, for example a generally vertical surface such as a wall or a post. The first end portion forms at least one aperture for connecting or fastening the mounting bracket to the surface using suitable fastening means or connectors.

A second end portion of the mounting bracket is mateably engageable with the drainage plate. For example, the second end portion is mateably engageable with the receiving surface formed in or integrated with the bottom surface of the drainage plate, thus securing the drainage plate to the mounting bracket.

As discussed above in reference to preferred embodiments of this invention, the container or pot is mateably engageable with the drainage plate whereby the pot is fixedly positioned with respect to the second end portion of the mounting bracket.

BRIEF DESCRIPTION OF THE DRAWINGS

The drawings show different features of an apparatus for supporting an object with respect to a support post, according to preferred embodiments of this invention, wherein.

DETAILED DESCRIPTION OF PREFERRED EMBODIMENTS

Figure 1:
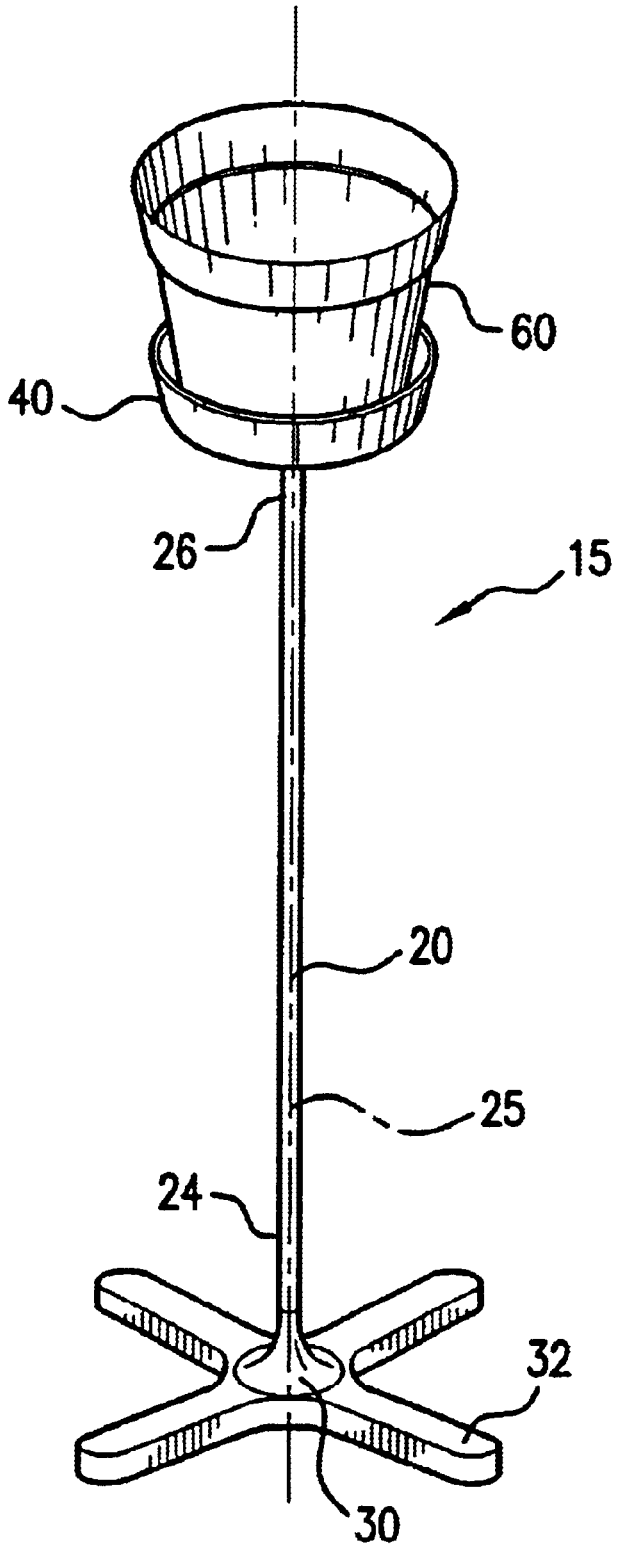
FIG. 1 is a perspective view of an apparatus for supporting an object such as a house plant with respect to a support post, according to one preferred embodiment of this invention.

In preferred embodiments of this invention as shown in FIGS. 1–5, an apparatus, for example a stand 15, for supporting an object such as a house plant comprises a support post 20. Preferably, but not necessarily, support post 20 is cylindrical having a vertical axis 25 therethrough, as shown in FIG. 1. Preferably, but not necessarily, support post 20 has a circular cross-sectional area along at least a portion of a length of support post 20. It is apparent that support post 20 may have any other suitable cross-sectional shape. For example, support post 20 may have a rectangular cross-sectional area or triangular cross-sectional area along at least a portion of the support post length.

In one preferred embodiment of this invention as shown in FIG. 1, a base 30 is connected to a first end portion 24 of support post 20, for example at a lower or bottom end portion of support post 20. Preferably, but not necessarily, support post 20 is threadedly connected to base 30, is welded or otherwise adhered to base 30, or is integrated with base 30. Other suitable connecting means known to those having ordinary skill in the art may be used to securely connect support post 20 to base 30. As shown in FIG. 1, base 30 has a plurality of feet 32 to further support stand 15. Base 30 may have any suitable number of feet 32, for example three feet or four feet, or may have enough surface area to require no feet.

Figure 2:
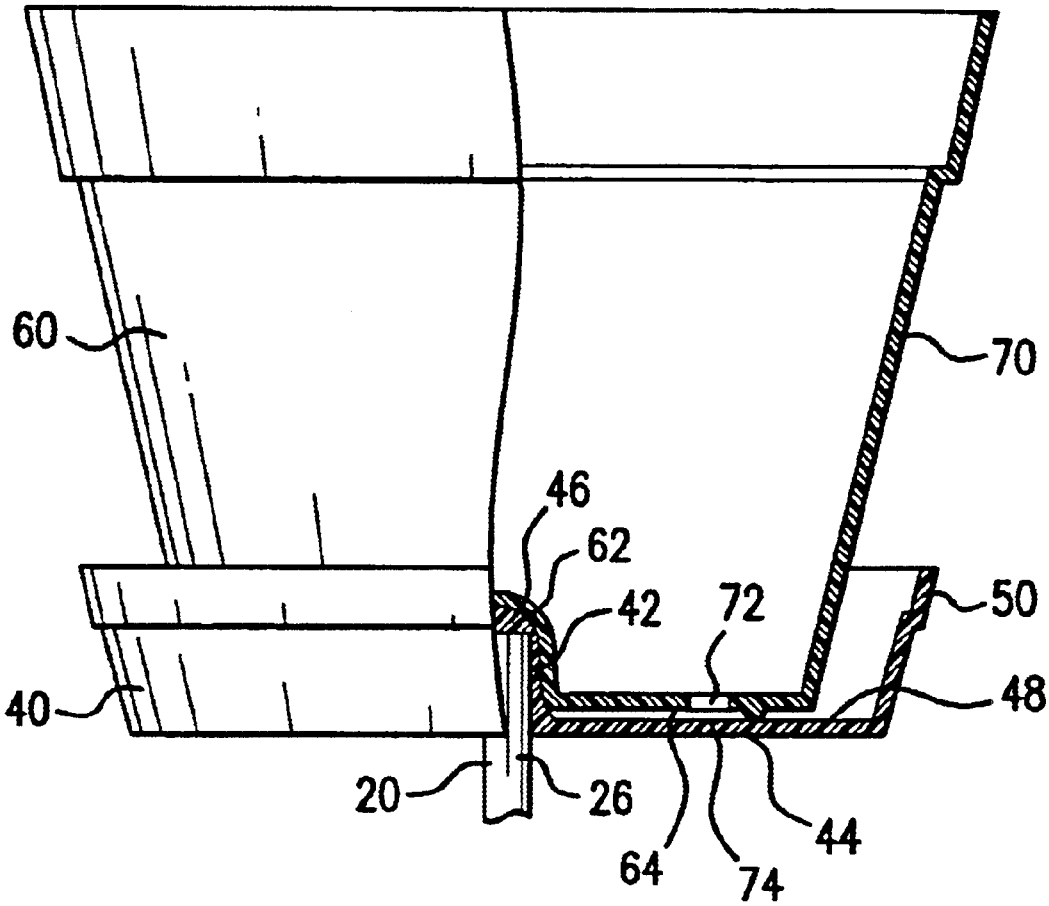
FIG. 2 is a partial sectional side view of a drainage plate mateably engaged with a pot, according to one preferred embodiment of this invention.

As shown in FIGS. 1 and 2, support post 20 at a second end portion 26, for example an upper or top end portion, is mateably engageable with a drainage plate 40. Preferably, but not necessarily, drainage plate 40 is securely engaged with support post 20. For example, as shown in FIG. 2, second end portion 26 is mateably engageable with a receiving surface 42 formed in or integrated with a bottom surface 44 of drainage plate 40, thus securing drainage plate 40 to support post 20. In one embodiment of this invention, second end portion 26 forms a threaded connection with receiving surface 42. Preferably, receiving surface 42 is formed in central area, for example about a center point of bottom surface 44, to align a vertical axis of drainage plate 40 with vertical axis 25 of support post 20.

Figure 3:
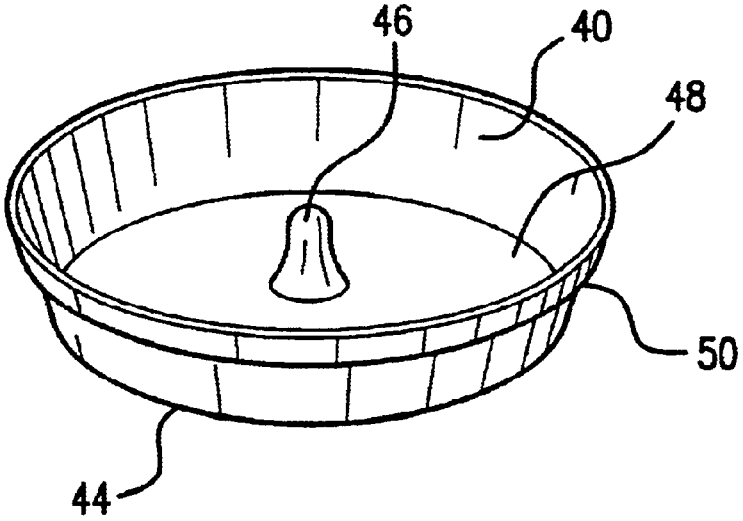
FIG. 3 is a perspective top view of a drainage plate forming a projection, according to one preferred embodiment of this invention.

In one preferred embodiment of this invention, a projection 46 is formed in a top surface 48 of drainage plate 40 and projects or extends into a void formed by a peripheral wall 50 of drainage plate 40, as shown in FIGS. 2 and 3. Projection 46 is positioned directly above receiving surface 42 and coaxially positioned with vertical axis 25 about the vertical axis of drainage plate 40. Preferably, projection 46, as well as receiving surface 42, is integrated with drainage plate 40. Preferably, but not necessarily, at least a portion of projection 46 has a generally conical shape. Projection 46 may have any suitable shape. Except for projection 46, top surface 48 is preferably generally flat. Peripheral wall 50 has a height sufficient to maintain a volume of water within the volume formed in drainage plate 40 by peripheral wall 50, if desired.

Figure 4:
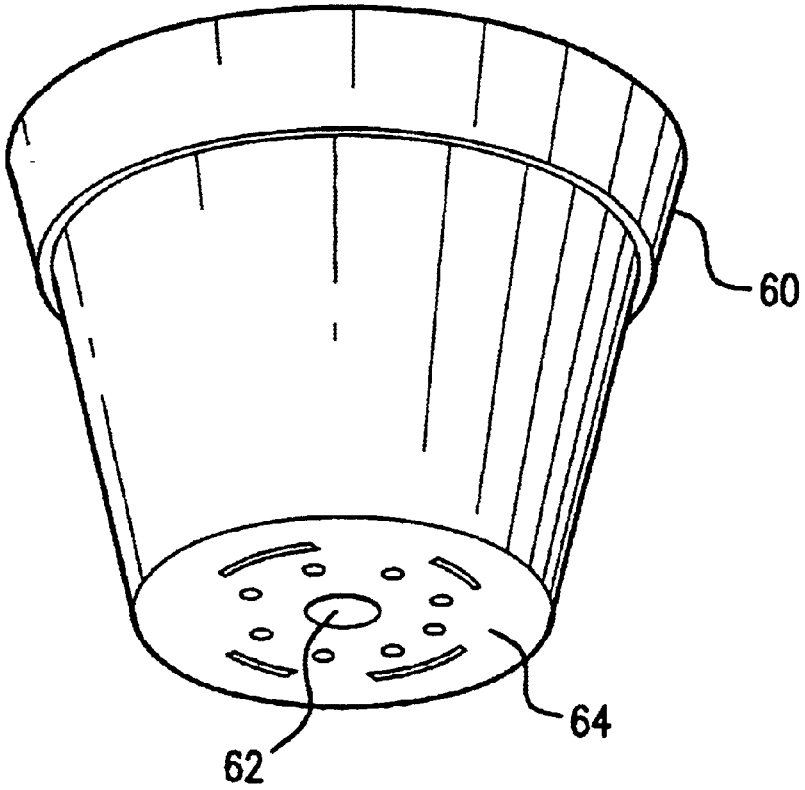
FIG. 4 is a perspective bottom view of a pot forming a receptacle, according to one preferred embodiment of this invention.
Figure 5:
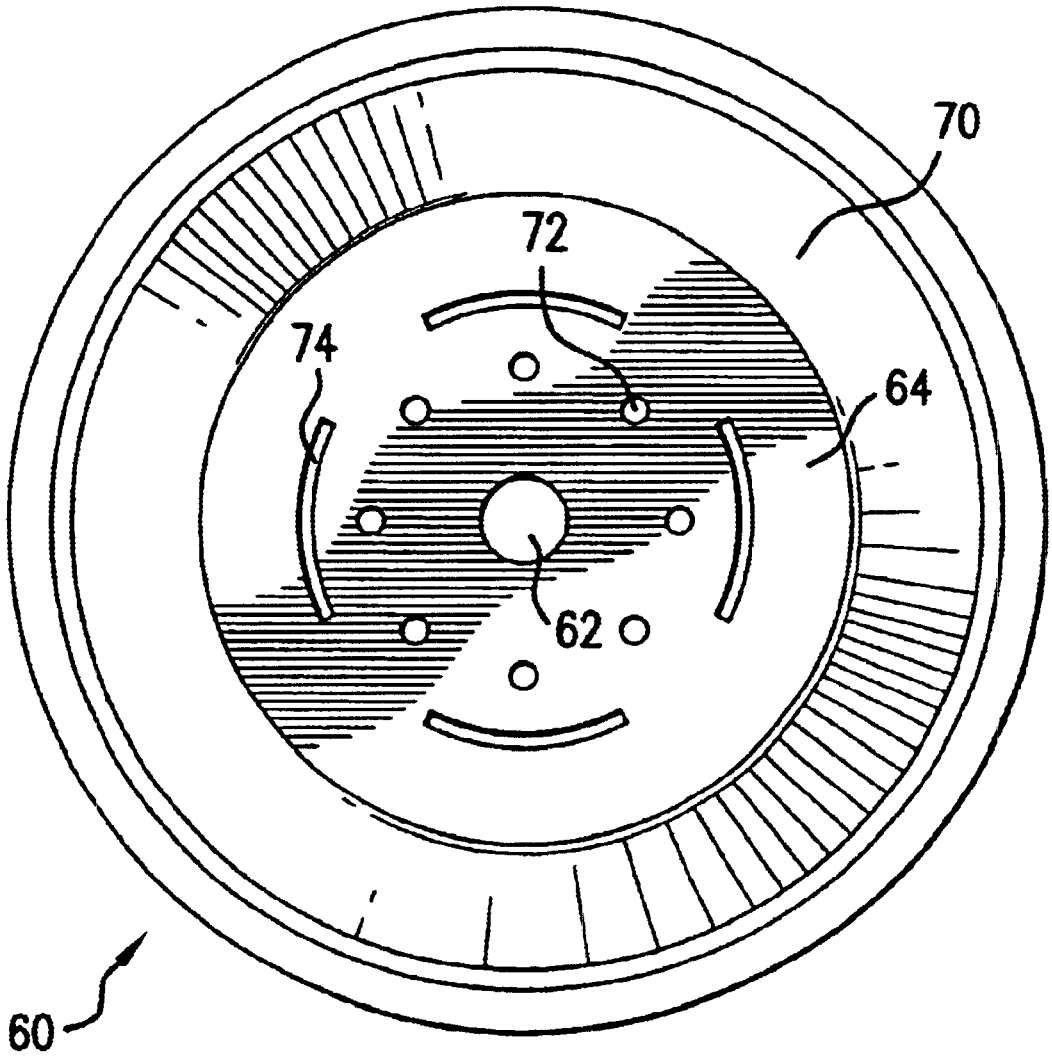
FIG. 5 is a bottom view of a pot forming a plurality of apertures and a plurality of support walls, according to one preferred embodiment of this invention.

In one preferred embodiment of this invention as shown in FIGS. 1 and 2, a container or pot 60, containing soil for a plant, is mateably engageable with drainage plate 40. Preferably, as shown in FIGS. 2, 4 and 5, a receptacle 62 is formed in or integrated with a bottom surface 64 of pot 60. As shown in FIG. 2, at least a portion of bottom surface 64 forming receptacle 62 extends or projects into a void formed by a peripheral wall 70 of pot 60. In one preferred embodiment of this invention, projection 46 is mateably engageable with receptacle 62. For example, at least a portion of top surface 48 forming projection 46 contacts at least a portion of bottom surface 64 forming receptacle 62 whereby pot 60 is fixedly positioned about vertical axis 25. Thus, although pot 60 may rotate about vertical axis 25, pot 60 is prevented from vertical movement or displacement along vertical axis 25 with respect to drainage plate 40 and/or lateral movement or displacement along a horizontal axis with respect to drainage plate 40. In one embodiment of this invention, pot 60 is fixedly positioned on drainage plate 40 such that a center of mass of pot 60 is fixedly positioned about vertical axis 25. The term "center of mass" describes a point at which the entire mass of a body may be considered concentrated for some purposes. Thus, pot 60 is properly positioned and balanced upon drainage plate 40 and with respect to support post 20 to prevent stand 15 from tipping and/or falling over.

Preferably, top surface 48 forms projection 46 having a height which directly corresponds to a depth of receptacle 62 formed by bottom surface 64. Further, preferably a substantial portion of top surface 48 contacts a substantial portion of bottom surface 64 to provide sufficient frictional contact between projection 46 and receptacle 62, to maintain pot 60 in a desired, predetermined position with respect to drainage plate 40 and/or support post 20. For example, as shown in FIG. 2, top surface 48 of projection 46 directly corresponds to bottom surface 64 of receptacle 62 to provide increased frictional contact between a substantial portion of top surface 48 and bottom surface 64.

In one preferred embodiment of this invention, the apparatus comprises the combination of drainage plate 40 mateably engaged with pot 60 but without support post 20. Because receiving surface 42 extends or projects into the volume formed by drainage plate 40, bottom surface 44 is generally flat, except for receiving surface 42, and can rest upon any generally flat horizontal surface, for example a ledge, a table or a shelf, to support pot 60 and its contents. Pot 60 is centered and maintained in the desired position upon drainage plate 40 by the mating engagement of projection 46 with receptacle 62.

In one preferred embodiment of this invention as shown in FIG. 5, pot 60 further comprises at least one, and preferably a plurality of apertures 72 formed by and extending through bottom surface 64 of pot 60. Preferably, but not necessarily, apertures 72 are radially positioned about receptacle 62, as shown in FIG. 5. Apertures 72 each may have any suitable shape. Preferably, apertures 72 have a generally circular shape having a suitable diameter to allow for proper water drainage. For example, if a house plant is planted within the volume formed by peripheral wall 70 of pot 60, upon conventional watering of the plant, the excess water is drained from within pot 60 through apertures 72 and contained within the volume formed by peripheral wall 50 of drainage plate 40.

In one preferred embodiment of this invention as shown in FIG. 5, pot 60 further comprises at least one, and preferably a plurality of support walls 74. Preferably, but not necessarily, support walls 74 have a generally arcuate shape and are positioned in a circumferential or radial relationship with respect to receptacle 62, as shown in FIG. 5. Support walls 74 may have any suitable shape. For example, support walls 74 may be generally straight or linear. Support walls 74 provide both support and stability for pot 60, to ensure that the weight of pot 60 and its contents are evenly distributed onto top surface 48 of drainage plate 40, and providing a means for irrigating and/or directing a movement of water, for example, through apertures 72 and between bottom surface 64 and top surface 48 to a periphery of drainage plate 40.

Figure 6:
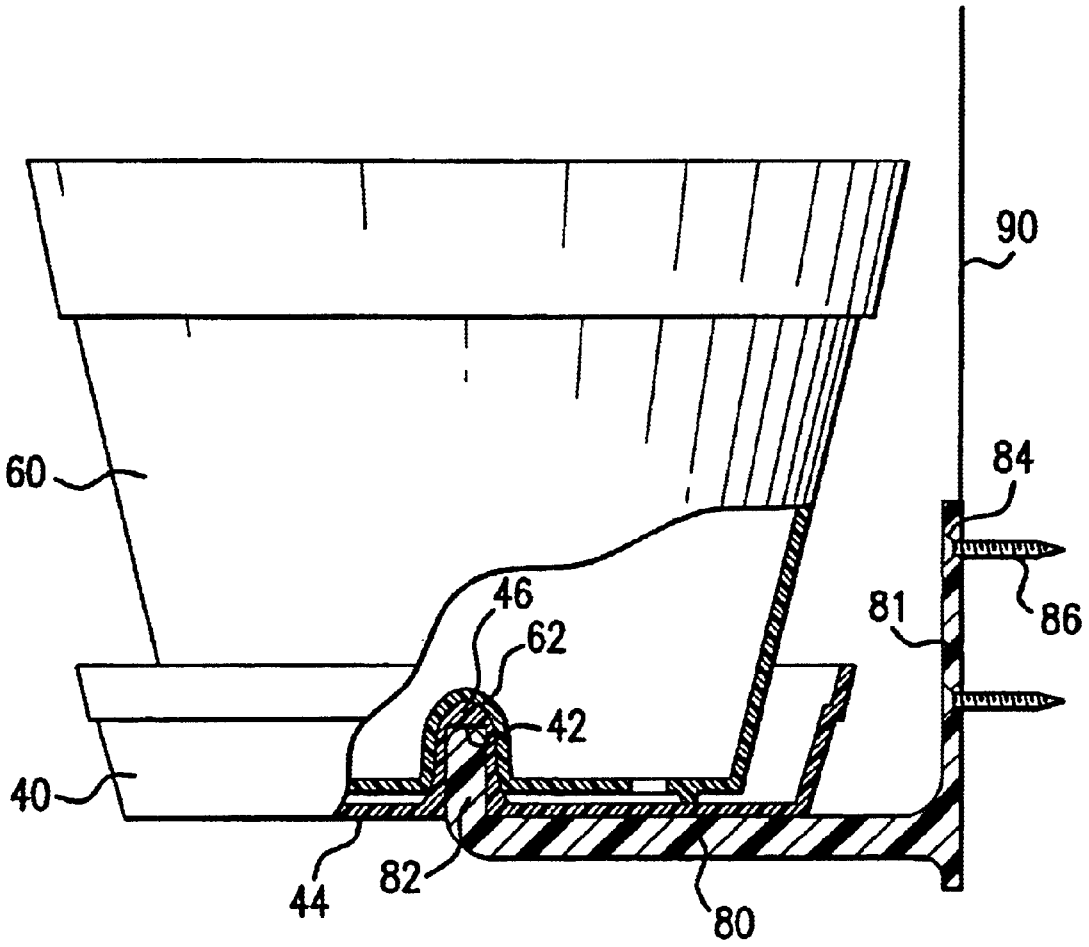
FIG. 6 is a partial sectional view of an apparatus for supporting an object such as a house plant with respect to a mounting bracket, according to one preferred embodiment of this invention.
Figure 8:
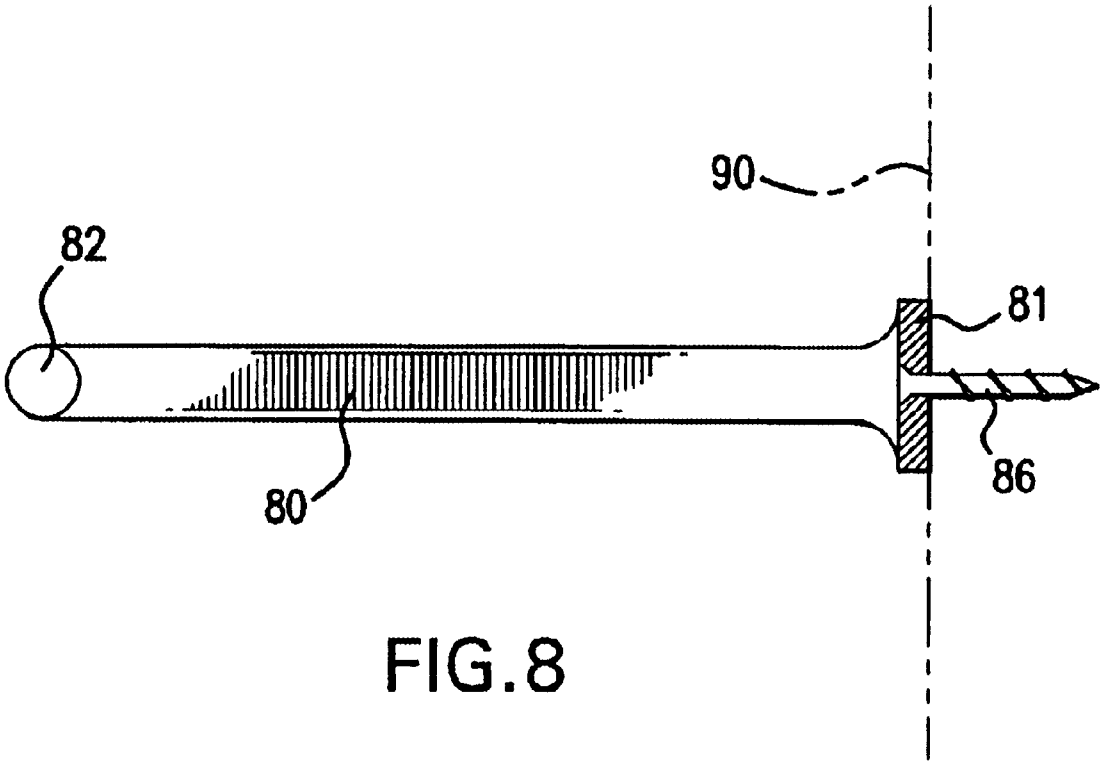
FIG. 8 is a partial sectional top view of a mounting bracket, according to one preferred embodiment of this invention.
Figure 7:
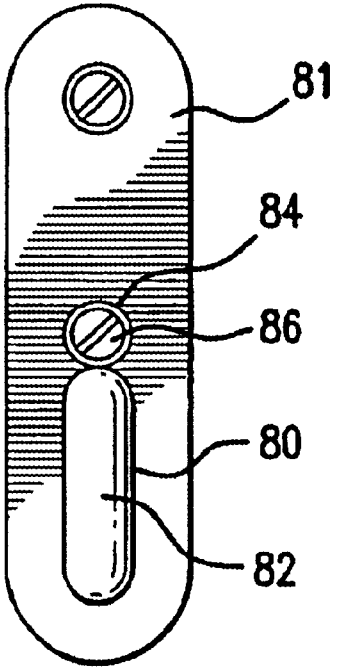
FIG. 7 is a front view of a mounting bracket, according to one preferred embodiment of this invention.

In one preferred embodiment of this invention as shown in FIGS. 6–8, an apparatus for supporting an object such as a house plant comprises a mounting bracket 80. For example, the apparatus comprising mounting bracket 80 may support a house plant with respect to a generally vertical surface such as an interior wall surface. Preferably, at least a portion of mounting bracket 80 is cylindrical. Preferably, but not necessarily, mounting bracket 80 has a circular cross-sectional area along at least a portion of a length of mounting bracket 80. It is apparent that mounting bracket 80 may have any other suitable cross-sectional shape. For example, mounting bracket 80 may have a rectangular cross-sectional area or triangular cross-sectional area along at least a portion of the mounting bracket length.

As shown in FIGS. 6–8, a first end portion 81 of mounting bracket 80 is adapted for mounting the apparatus to a surface. For example, as shown in FIG. 6, mounting bracket 80 may be securely fastened to a generally vertical surface 90, such as an interior wall, an exterior wall or a post. It is apparent to those having ordinary skill in the art, that mounting bracket 80 may be adapted to mount securely to any other surface, for example a generally horizontal surface.

As shown in FIGS. 6–8, first end portion 81 forms at least one, and preferably a plurality of apertures 84 for connecting or fastening mounting bracket 80 to surface 90. Suitable fastening means or connectors, for example screws 86, may be used for securing mounting bracket 80 to surface 90. Other suitable connecting means known to those having ordinary skill in the art may be used to securely connect mounting bracket 80 to surface 90.

A second end portion 82 of mounting bracket 80 is mateably engageable with drainage plate 40. Preferably, but not necessarily, drainage plate 40 is securely engaged with mounting bracket 80. For example, as shown in FIG. 6, second end portion 82 is mateably engageable with receiving surface 42 formed in or integrated with bottom surface 44 of drainage plate 40, thus securing drainage plate 40 to mounting bracket 80. In one embodiment of this invention, second end portion 82 forms a threaded connection with receiving surface 42. Preferably, receiving surface 42 is formed in central area, for example about a center point of bottom surface 44, to align a vertical axis of drainage plate 40 with a central axis of second end portion 82.

As discussed above in reference to preferred embodiments of this invention as shown in FIGS. 1–5, container or pot 60 is mateably engageable with drainage plate 40. Preferably, as shown in FIG. 6, receptacle 62 is formed in or integrated with bottom surface 64 of pot 60. In one preferred embodiment of this invention, projection 46 is mateably engageable with receptacle 62 whereby pot 60 is fixedly positioned with respect to second end portion 82.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

I claim:

1. An apparatus for supporting a plant comprising: a pot containing soil for a plant; said pot having a bottom surface forming a central receptacle, said central receptacle extending into at least a portion of a void formed by said pot; said central receptacle having a closed end and an open end; a drainage plate forming a central projection mateably engageable with said central receptacle, an inner surface of said central projection defining a closed bore and an outer surface of said central projection frictionally engaging said central receptacle; said bottom surface of said pot containing apertures in communication with said drainage plate; a support post secured within said central projection; said support post extending downwardly from said drainage plate, and said inner surface frictionally fitting with an upper portion of said support post to form a secure connection between said support post and said drainage plate.

2. The apparatus of claim 1 further comprising a base connected to a bottom end portion of said support post.

3. The apparatus of claim 1 wherein said support post is threadedly mateable with said closed bore.

4. The apparatus of claim 1 wherein said container further comprises at least one support wall extending from said bottom surface.

5. The apparatus of claim 4 wherein said at least one support wall has an arcuate shape.

6. The apparatus of claim 1 wherein said apertures are radially positioned about said central receptacle.

* * * * *